US010159310B2

(12) United States Patent
Sullivan

(10) Patent No.: US 10,159,310 B2
(45) Date of Patent: Dec. 25, 2018

(54) REAR CLOSING UPPER FOR AN ARTICLE OF FOOTWEAR WITH FRONT ZIPPER TO REAR CORD CONNECTION

(71) Applicant: NIKE, Inc., Beaverton, OR (US)

(72) Inventor: Gerald Sullivan, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 38 days.

(21) Appl. No.: 15/605,071

(22) Filed: May 25, 2017

(65) Prior Publication Data

US 2018/0338583 A1 Nov. 29, 2018

(51) Int. Cl.

| | |
|---|---|
| ***A43C 11/12*** | (2006.01) |
| ***A43B 23/02*** | (2006.01) |
| ***A43C 11/00*** | (2006.01) |
| *A43B 3/06* | (2006.01) |

(52) U.S. Cl.

CPC ..... *A43B 23/0245* (2013.01); *A43C 11/008* (2013.01); *A43C 11/12* (2013.01); *A41D 2300/322* (2013.01); *A43B 3/06* (2013.01)

(58) Field of Classification Search

CPC ..... A43C 11/008; A43C 11/12
USPC ..... 36/50.1, 105
See application file for complete search history.

(56) References Cited

U.S. PATENT DOCUMENTS

| | | | |
|---|---|---|---|
| 4,497 | A | 5/1846 | Vetter |
| 75,048 | A | 3/1868 | Perley |
| 171,301 | A | 12/1875 | McKee |
| 417,460 | A | 12/1889 | Wurtele |
| 474,574 | A | 5/1892 | Bruzon |
| 503,588 | A | 8/1893 | Elterich et al. |
| 537,627 | A | 4/1895 | Bixby et al. |
| 558,937 | A | 4/1896 | Edmonds |
| 808,948 | A | 1/1906 | Roberts |
| 827,330 | A | 7/1906 | Tillson |
| 863,549 | A | 8/1907 | Metz |

(Continued)

FOREIGN PATENT DOCUMENTS

| | | |
|---|---|---|
| CN | 2052208 U | 2/1990 |
| CN | 2112959 U | 8/1992 |

(Continued)

OTHER PUBLICATIONS

U.S. Appl. No. 62/486,311, filed Apr. 17, 2017.

(Continued)

*Primary Examiner* — Marie D Bays
(74) *Attorney, Agent, or Firm* — Quinn IP Law

(57) ABSTRACT

An article of footwear comprises a sole structure, and an upper. The upper includes a front section and a rear section, both secured to the sole structure. The front section is fixed to the sole structure at least partially forward of the rear section and includes a medial portion and a lateral portion that together define a foot-receiving cavity over the sole structure, and a foot entry opening of the foot-receiving cavity. A zipper is secured to the medial portion and to the lateral portion. The zipper includes a slider movable between a zipped position and an unzipped position forward of the zipped position. An anchor is secured to one of the front section or the sole structure forward of the zipped position of the slider, and a cord is engaged with the zipper and with the rear section of the upper, and routed through the anchor.

20 Claims, 8 Drawing Sheets

(56) References Cited

U.S. PATENT DOCUMENTS 955,337 A 4/1910 Lawlor
1,081,678 A 12/1913 Langerak
1,494,236 A 5/1924 Greathouse
1,585,049 A 5/1926 Skoglund
1,603,144 A 10/1926 Nichols
1,686,175 A 10/1928 Read
2,069,752 A 2/1937 Dorr
2,252,315 A 8/1941 Doree
2,297,657 A * 9/1942 L Hollier ..... A43C 11/12 24/387
2,302,596 A 11/1942 Bigio
2,330,224 A * 9/1943 L Hollier ..... A43B 3/02 36/50.1
2,345,057 A * 3/1944 Marinetti ..... A43C 11/12 36/50.1
2,357,980 A 9/1944 Spiro
2,450,250 A 9/1948 Napton
2,452,502 A 10/1948 Tarbox
2,452,649 A 11/1948 Graves
2,487,227 A 11/1949 Eberle
2,619,744 A 12/1952 Mattes
2,693,039 A 11/1954 Balut
2,736,110 A 2/1956 Hardimon
2,746,178 A 5/1956 Miller et al.
2,920,402 A 1/1960 Minera
3,039,207 A 6/1962 Lincors
3,146,535 A 9/1964 Owings
3,192,651 A 7/1965 Smith
3,349,505 A 10/1967 Lopez
3,400,474 A 9/1968 Tendler
3,436,842 A 4/1969 Sachs
3,589,038 A * 6/1971 Sailer ..... A43B 3/30 36/112
3,681,860 A 8/1972 Bidegain
4,095,356 A 6/1978 Robran et al.
4,136,468 A 1/1979 Munschy
4,309,832 A 1/1982 Hunt
4,489,509 A 12/1984 Libit
4,507,879 A 4/1985 Dassler
4,559,724 A 12/1985 Norton
4,562,651 A 1/1986 Frederick et al.
4,573,457 A 3/1986 Parks
4,594,798 A 6/1986 Autry et al.
4,599,811 A 7/1986 Rousseau
4,615,126 A 10/1986 Mathews
4,649,656 A 3/1987 Cox et al.
4,665,634 A 5/1987 Diaz
4,944,099 A 7/1990 Davis
4,972,613 A 11/1990 Loveder
5,054,216 A 10/1991 Lin
5,090,140 A 2/1992 Sessa
5,181,331 A 1/1993 Berger
5,184,410 A 2/1993 Hamilton
5,222,313 A 6/1993 Dowdy et al.
5,279,051 A 1/1994 Whatley
5,282,327 A 2/1994 Ogle
5,341,583 A 8/1994 Hallenbeck
5,371,957 A 12/1994 Gaudio
5,467,537 A 11/1995 Aveni et al.
5,481,814 A 1/1996 Spencer
5,557,866 A 9/1996 Prengler
5,570,523 A 11/1996 Lin
5,682,687 A 11/1997 Arai
5,813,144 A 9/1998 Prengler
5,842,292 A 12/1998 Siesel
6,000,148 A 12/1999 Cretinon
6,189,239 B1 2/2001 Gasparovic et al.
6,298,582 B1 10/2001 Friton et al.
6,378,230 B1 4/2002 Rotem et al.
6,438,872 B1 8/2002 Chil et al.
6,557,271 B1 5/2003 Weaver, III
6,578,288 B2 6/2003 Bernstein
6,594,921 B2 7/2003 Laio et al.
6,643,954 B2 11/2003 Voswinkel
6,684,533 B1 2/2004 Su
6,718,658 B2 4/2004 Karasawa
6,817,116 B2 11/2004 Chil et al.
6,883,254 B2 4/2005 Miller et al.
6,925,732 B1 8/2005 Clarke
6,938,361 B2 9/2005 Su
6,957,504 B2 10/2005 Morris
7,055,268 B2 6/2006 Ha
7,080,468 B2 7/2006 Miller et al.
7,101,604 B1 9/2006 Minges
7,103,994 B2 9/2006 Johnson
7,127,837 B2 10/2006 Ito
7,178,270 B2 2/2007 Hurd et al.
7,188,438 B1 3/2007 Bowen
7,225,563 B2 6/2007 Chen et al.
7,284,341 B2 10/2007 Moseley
7,287,294 B2 10/2007 Miller et al.
7,439,837 B2 10/2008 McDonald
7,448,148 B2 11/2008 Martinez et al.
7,472,495 B2 1/2009 Milbourn
7,526,881 B2 5/2009 Jones et al.
7,581,337 B2 9/2009 Miller et al.
7,607,242 B2 10/2009 Karandonis et al.
7,685,747 B1 3/2010 Gasparovic et al.
7,694,435 B1 4/2010 Kiser et al.
7,735,244 B1 6/2010 Ameche
7,793,438 B1 9/2010 Busse et al.
7,823,299 B1 11/2010 Brigham
7,900,377 B1 3/2011 Perenich
7,905,033 B1 3/2011 Perenich
7,913,422 B1 3/2011 Perenich
7,950,166 B1 5/2011 Perenich
7,975,403 B2 7/2011 Mosher
8,020,317 B1 9/2011 Sokolowski
D648,512 S 11/2011 Schlageter et al.
8,065,819 B2 11/2011 Kaufman
8,161,669 B2 4/2012 Keating
8,171,657 B1 5/2012 Perenich
8,215,030 B2 7/2012 Bowen et al.
8,225,534 B2 7/2012 Mueller et al.
8,245,418 B2 8/2012 Paintin et al.
8,245,421 B2 8/2012 Baudouin et al.
8,256,146 B2 9/2012 Loverin
8,365,443 B2 2/2013 Huynh
8,468,721 B2 6/2013 Sokolowski
8,468,723 B2 6/2013 Malka-Harari
8,499,474 B2 8/2013 Kaufman
8,549,774 B2 10/2013 Meschter et al.
8,627,582 B2 1/2014 Perenich
8,627,583 B2 1/2014 Perenich
8,635,791 B2 1/2014 Baudouin et al.
8,677,656 B2 3/2014 Nishiwaki et al.
8,745,893 B2 6/2014 Gavrieli et al.
8,763,275 B2 7/2014 Shalom et al.
8,769,845 B2 7/2014 Lin
8,834,770 B2 9/2014 Nakano
8,919,015 B2 12/2014 Holt et al.
9,015,962 B2 4/2015 Boudreau et al.
9,032,646 B2 5/2015 Perenich
9,061,096 B2 6/2015 Taylor et al.
9,089,184 B1 7/2015 Kiser et al.
9,095,188 B2 8/2015 Cavaliere
9,119,436 B1 9/2015 Ardell et al.
9,119,437 B2 9/2015 Weller et al.
9,144,262 B2 9/2015 Ardell et al.
9,173,451 B2 11/2015 Shim
9,254,018 B2 2/2016 Bliss
9,265,305 B2 2/2016 Hatfield et al.
9,301,570 B2 4/2016 Hwang
9,314,055 B2 4/2016 Moran
9,392,843 B2 7/2016 Callahan et al.
9,398,785 B2 7/2016 Horacek
9,398,786 B2 7/2016 Gavrieli et al.
9,414,640 B2 8/2016 Nichols
9,433,256 B2 9/2016 Callahan et al.
9,480,299 B2 11/2016 Dinndorf et al.
9,820,527 B2 11/2017 Pratt et al.
2002/0144434 A1 10/2002 Farys et al.
2002/0174568 A1 11/2002 Neiley
2004/0111921 A1 6/2004 Lenormand

(56) References Cited

U.S. PATENT DOCUMENTS

| | | | | |
|---|---|---|---|---|
| 2004/0134099 | A1* | 7/2004 | Jones | A43C 11/008 36/50.1 |
| 2005/0039348 | A1 | 2/2005 | Raluy et al. | |
| 2005/0060913 | A1 | 3/2005 | Chil et al. | |
| 2005/0066548 | A1 | 3/2005 | Chil et al. | |
| 2007/0011917 | A1 | 1/2007 | Hayes | |
| 2007/0039208 | A1 | 2/2007 | Bove et al. | |
| 2007/0074425 | A1 | 4/2007 | Leong | |
| 2007/0186441 | A1 | 8/2007 | Chen | |
| 2007/0199211 | A1 | 8/2007 | Campbell | |
| 2007/0199213 | A1 | 8/2007 | Campbell et al. | |
| 2007/0240334 | A1* | 10/2007 | Johnson | A43C 7/04 36/50.1 |
| 2008/0000106 | A1 | 1/2008 | Culpepper | |
| 2008/0086911 | A1* | 4/2008 | Labbe | A43B 11/00 36/50.1 |
| 2008/0141562 | A1 | 6/2008 | Peveto | |
| 2008/0307673 | A1 | 12/2008 | Johnson | |
| 2009/0025260 | A1 | 1/2009 | Nakano | |
| 2010/0319216 | A1* | 12/2010 | Grenzke | A43B 11/00 36/54 |
| 2011/0016751 | A1 | 1/2011 | Somerville | |
| 2011/0146106 | A1 | 6/2011 | Kaufman | |
| 2012/0079746 | A1 | 4/2012 | Ferreira et al. | |
| 2012/0317839 | A1 | 12/2012 | Pratt | |
| 2013/0185959 | A1 | 7/2013 | Coleman | |
| 2013/0219747 | A1 | 8/2013 | Lederer | |
| 2014/0013624 | A1 | 1/2014 | Stockbridge et al. | |
| 2014/0115925 | A1 | 5/2014 | Hurd et al. | |
| 2014/0250723 | A1 | 9/2014 | Kohatsu | |
| 2014/0298687 | A1 | 10/2014 | Flinterman et al. | |
| 2014/0305005 | A1 | 10/2014 | Yeh | |
| 2014/0310992 | A1 | 10/2014 | Shalom et al. | |
| 2014/0360049 | A1 | 12/2014 | Panian et al. | |
| 2015/0113834 | A1 | 4/2015 | Dojan et al. | |
| 2015/0143720 | A1 | 5/2015 | Avar | |
| 2015/0196095 | A1 | 7/2015 | Chapman | |
| 2015/0216252 | A1 | 8/2015 | Wiens | |
| 2015/0289595 | A1 | 10/2015 | Rushbrook et al. | |
| 2015/0305432 | A1 | 10/2015 | Wiens | |
| 2016/0128429 | A1 | 5/2016 | Hatfield et al. | |
| 2016/0242493 | A1 | 8/2016 | Stillwagon | |
| 2017/0042290 | A1 | 2/2017 | Hatfield et al. | |
| 2018/0110287 | A1 | 4/2018 | Hopkins et al. | |
| 2018/0110288 | A1 | 4/2018 | Hatfield et al. | |
| 2018/0110292 | A1 | 4/2018 | Beers et al. | |

FOREIGN PATENT DOCUMENTS

| | | | |
|---|---|---|---|
| CN | 2438353 | Y | 7/2001 |
| CN | 1403041 | A | 3/2003 |
| CN | 201005111 | Y | 1/2008 |
| CN | 102595952 | B | 4/2015 |
| DE | 3310988 | A1 | 9/1984 |
| DE | 19534249 | A1 | 3/1997 |
| DE | 19611797 | A1 | 10/1997 |
| DE | 29809404 | U1 | 8/1998 |
| DE | 10247163 | A1 | 4/2004 |
| DE | 102004005288 | A1 | 8/2005 |
| DE | 102013200701 | A1 | 7/2013 |
| EP | 0570621 | A1 | 11/1993 |
| EP | 1059044 | A1 | 12/2000 |
| EP | 1952715 | A1 | 8/2008 |
| EP | 2277402 | A2 | 1/2011 |
| EP | 2490565 | A1 | 8/2012 |
| EP | 2818068 | A1 | 12/2014 |
| FR | 2994800 | A1 | 3/2014 |
| GB | 1154145 | A | 6/1969 |
| GB | 1358470 | A | 7/1974 |
| GB | 2517399 | A | 2/2015 |
| GB | 2533809 | A | 7/2016 |
| JP | H0181910 | U | 6/1989 |
| JP | 2001149394 | A | 6/2001 |
| JP | 2004236860 | A | 8/2004 |
| JP | 2006055571 | A | 3/2006 |
| JP | 2008206629 | A | 9/2008 |
| KR | 20090130804 | A | 12/2009 |
| WO | 8808678 | A1 | 11/1988 |
| WO | 03039283 | A1 | 5/2003 |
| WO | 2005029991 | A1 | 4/2005 |
| WO | 2006084185 | A1 | 8/2006 |
| WO | 2007024875 | A2 | 3/2007 |
| WO | 2007080205 | A1 | 7/2007 |
| WO | 2008115743 | A1 | 9/2008 |
| WO | 2009154350 | A1 | 12/2009 |
| WO | 2010059716 | A2 | 5/2010 |
| WO | 2010114993 | A1 | 10/2010 |
| WO | 2011004946 | A1 | 1/2011 |
| WO | 2012044974 | A1 | 4/2012 |
| WO | 2012168956 | A1 | 12/2012 |
| WO | 2014033396 | A1 | 3/2014 |
| WO | 2014140443 | A1 | 9/2014 |
| WO | 2015002521 | A1 | 1/2015 |
| WO | 2016005696 | A1 | 1/2016 |

OTHER PUBLICATIONS

Nike Ease Challenge Winner Announced, Nike News, Apr. 25, 2017, https://news.nike.com/news/nike-ease-challenge-winner-announced (accessed May 2, 2018).

U.S. Appl. No. 61/260,621, filed Nov. 12, 2009.

U.S. Appl. No. 62/326,650, filed Apr. 22, 2016.

U.S. Appl. No. 62/368,497, filed Jul. 29, 2016.

Kizik Design, Kizik® Shoes Launch Footwear Revolution with Patented Handsfree Technology, https://www.prnewswire.com/news-releases/kizik-shoes-launch-footwear-revolution-with-patented-handsfree-technology-300594838.html, Feb. 7, 2018.

Aidin H., Under Armour's Innovative Fall/Winter 2016 Collection Now Available at All Brand Houses, Aug. 27, 2016, https://www.runsociety.com/news/under-armours-innovative-fallwinter-2016-collection-now-available-at-all-brand-houses/ (accessed Nov. 4, 2017).

* cited by examiner

REAR CLOSING UPPER FOR AN ARTICLE OF FOOTWEAR WITH FRONT ZIPPER TO REAR CORD CONNECTION

TECHNICAL FIELD

The present teachings generally include an upper for an article of footwear having a rear section movable between open and closed positions via a zipper on the front section.

BACKGROUND

Traditionally, placing footwear on a foot often requires the use of one or both hands to stretch the ankle opening of a footwear upper, and hold the rear portion during foot insertion. The fit of the upper is then adjusted following foot insertion, such as by tying laces.

DESCRIPTION

Figure 1:
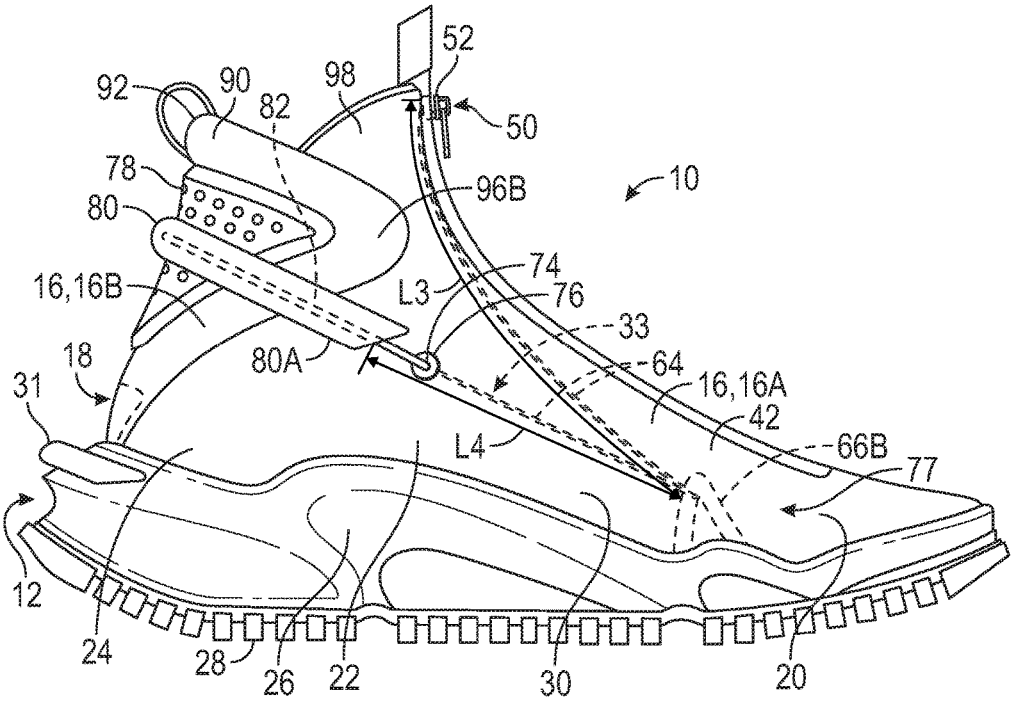
FIG. 1 is a lateral side view of an article of footwear with a zipper in a zipped position and a rear section of an upper in a closed position.

An article of footwear comprises a sole structure, and an upper. The upper includes a front section and a rear section, both secured to the sole structure. The front section is fixed to the sole structure at least partially forward of the rear section and includes a medial portion and a lateral portion that together partially define a foot-receiving cavity over the sole structure, and a foot entry opening of the foot-receiving cavity. The article of footwear further includes a zipper secured to the medial portion and to the lateral portion. The zipper includes a slider movable between a zipped position and an unzipped position. The unzipped position of the sider is forward of the zipped position. The medial portion and the lateral portion are zipped to one another when the slider is in the zipped position. An anchor is secured to one of the front section or the sole structure forward of the zipped position of the slider, and a cord is engaged with the zipper and with the rear section of the upper, and is routed through the anchor. The cord pulls the rear section forward toward the front section from an access position to a use position so that the rear section partially closes the foot entry opening when the slider is moved from the unzipped position to the zipped position. In an embodiment, the medial portion and the lateral portion of the front section spread laterally outward of the sole structure when the slider is in the unzipped position.

In an embodiment, the cord is engaged with the slider. For example, the slider may be a double-headed slider, with an inner head having a crown through which the cord extends. In another embodiment, the cord is a single-headed slider, and the cord extends through a loop at an inner side of the slider, or, in some embodiments, extends through a crown at an outer side of the slider.

In an embodiment, the anchor at least partially defines a loop, and the cord passes through the loop. The anchor is disposed internally of an exterior of the front section in some embodiments, and is disposed externally of an exterior of the front section in other embodiments.

In an embodiment, the front section of the upper has a cord opening rearward of the anchor and forward of the rear section. The cord extends through the cord opening such that the cord is exposed externally of the front section rearward of the cord opening, and extends internally of the front section forward of the cord opening. For example, the front section may include an inner layer and an outer layer. The cord may be disposed between the inner layer and the outer layer forward of the cord opening.

In an embodiment, the anchor is a lateral anchor disposed adjacent to the lateral portion, and the article of footwear further comprises a medial anchor secured to one of the medial portion or the sole structure forward of the zipped position of the slider. The cord may be routed through the medial anchor. In such an embodiment, the cord is routed through anchors at both a medial side and a lateral side of the front section.

In an embodiment, the rear section includes a hinge adjacent to the sole structure. For example, the rear section is sufficiently flexible to function as a hinge, and the hinge is an integral portion of the rear section. The cord engages with the rear section at a position intermediate the hinge and an uppermost extent of the rear section. In an embodiment, the article of footwear includes a conduit secured to the rear section, and the cord extends through the conduit. The conduit may at least partially define a channel extending in a U shape along the rear section. For example, the conduit may include a lateral arm and a medial arm, each of which extends forward of the rear section when the slider is in the zipped position, and each of which has a terminal end with an opening to the channel at the terminal end.

In an embodiment, the rear section includes a collar portion and the hinge is between the collar portion and the sole structure. The rear section articulates relative to the sole structure at the hinge when the cord is pulled by the slider moving to the zipped position. The collar portion overlaps the medial portion and the lateral portion of the front section when the slider is in the zipped position.

An upper for an article of footwear comprises a front section and a rear section. The front section includes a forefoot region and a midfoot region, and partially defines a foot-receiving cavity with a foot entry opening posterior of the midfoot region. The front section has a medial portion and a lateral portion. A zipper is secured to the medial portion and to the lateral portion. The zipper includes a slider movable between a zipped position and an unzipped position, with the unzipped position forward of the zipped position. The medial portion and the lateral portion are zipped to one another when the slider is in the zipped position. An anchor is disposed forward of the zipped position and adjacent to the front section. A cord is engaged with the zipper and with the rear section of the upper, and is routed through the anchor. The cord pulls the rear section forward toward the front section from an access position to a use position when the slider is moved from the unzipped position to the zipped position, the rear section partially closing the foot entry opening in the use position.

In an embodiment, the front section of the upper has a cord opening rearward of the anchor and forward of the rear section. The cord extends through the cord opening, and is exposed externally of the front section rearward of the cord opening, and extends internally of the front section and forward of the cord opening.

In an embodiment, the front section of the upper includes an inner layer and an outer layer. The cord is disposed between the inner layer and the outer layer forward of the cord opening. The medial portion and the lateral portion of the front section may spread laterally outward away from one another when the slider is in the unzipped position.

In an embodiment, the rear section includes a collar portion at an uppermost extent of the rear section. The collar portion overlaps the medial portion and the lateral portion of the front section when the slider is in the zipped position.

In an embodiment, the upper is in combination with a sole structure, and the medial portion, the lateral portion, and the rear section are secured to the sole structure. The rear section has a hinge and articulates relative to the sole structure at the hinge.

The above features and advantages and other features and advantages of the present teachings are readily apparent from the following detailed description of the modes for carrying out the present teachings when taken in connection with the accompanying drawings.

Referring to the drawings, wherein like reference numbers refer to like components throughout the views, FIG. 1 shows an article of footwear 10 that has a sole structure 12 and an upper 16 secured to the sole structure 12. The upper 16 is configured to facilitate foot entry and securement, as well as foot removal, in a relatively easy manner. More specifically, as disclosed herein, zipping a front section 16A of the upper 16 causes a rear section 16B of the upper to move from an open, access position shown in FIG. 1, to a closed, use position shown in FIG. 2. Unzipping the front section 16A enables the rear section 16B to return to the open position.

Figure 2:
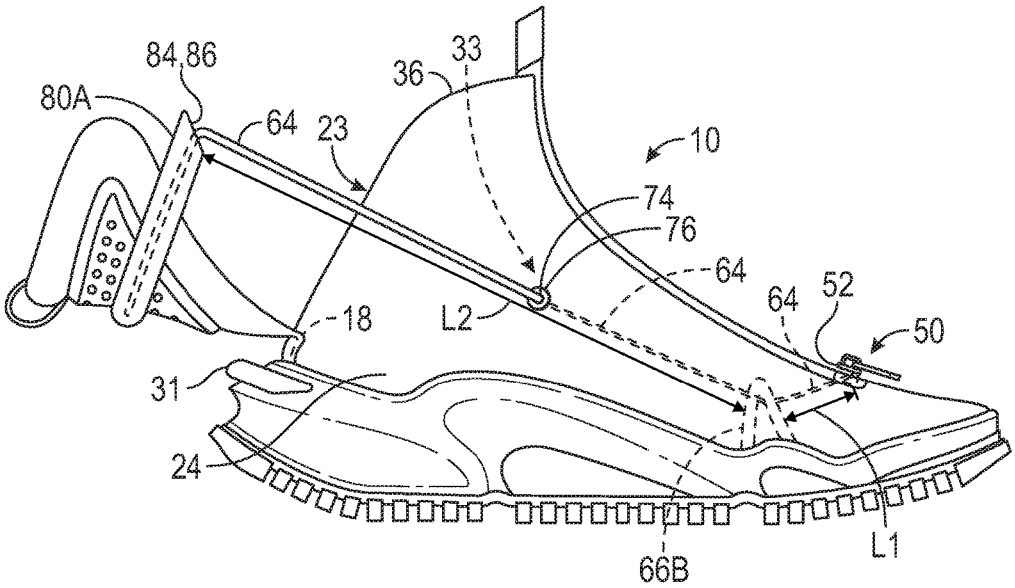
FIG. 2 is a lateral side view of the article of footwear of FIG. 1 with the zipper in an unzipped position and the rear section in an open position.
Figure 6:
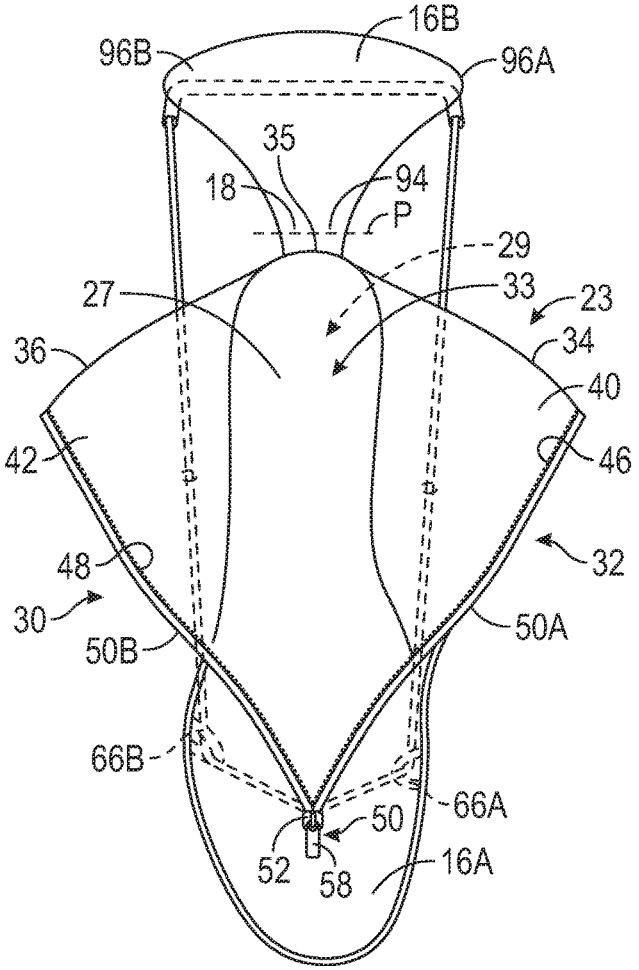
FIG. 6 is a plan view of the article of footwear of FIG. 2 with the front section of the upper spread open.
Figure 7:
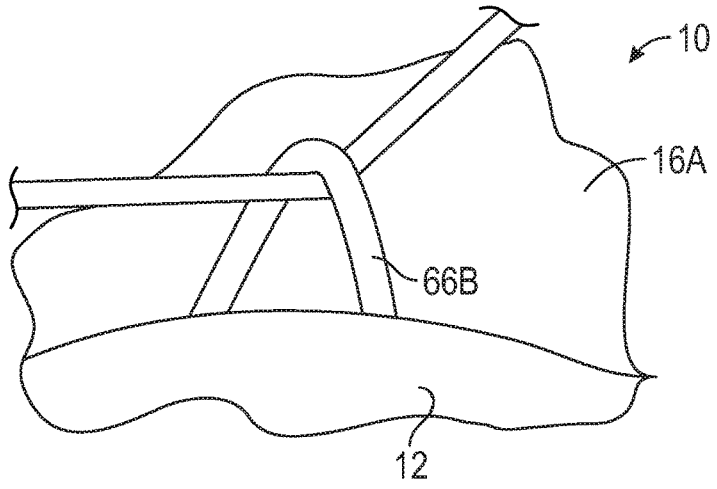
FIG. 7 is a fragmentary perspective view of a portion of the article of footwear taken from the foot-receiving cavity and showing an embodiment with an anchor secured to a sole structure internal to the upper.

As best shown in FIGS. 2 and 6, the rear section 16B is hinged to a heel region 24 of the sole structure 12 at a hinge 18 that is an integral portion of the rear section 16B. The front and rear sections 16A, 16B are configured to cooperate so that the rear section 16B moves from an access position (FIG. 2, also referred to as an unzipped position) to a use position (FIG. 1, also referred to as a zipped position), when a zipper 50 on the front section 16A is zipped. Stated differently, the rear section 16B pivots at a hinge 18 of the rear section 16B in the heel region 24 between the access position and the use position. In the access position, the rear section 16B is rearward of the heel region 24 and spaced apart from a medial edge 34 and a lateral edge 36 of the front section 16A. In the use position, the rear section 16B partially overlaps the front section 16A. As used herein, movable "between" the access position and the use position means that the rear section 16B may be moved from one of the positions to the other of the positions. The zipper 50 may be a self-locking zipper, such that it remains at the zipped position in the absence of a force on the slider 52, such as by pulling on the zipper pull 58, moving it toward the unzipped position. In another embodiment, the zipper 50 could have multiple stops such that it can be selectively stopped and locked at various positions.

As discussed herein, these and other features of the upper 16 and the article of footwear 10 enable the access position to afford easy foot entry into the article of footwear 10. The access position provides a large foot entry opening 23 (see FIGS. 2 and 6) that angles upward from back to front (see FIG. 2) as described herein, allowing foot access from the rear with little obstruction from or need to move any of the upper 16 in order to insert the foot. The foot entry opening 23 may be especially helpful for easing foot entry for those with relatively inflexible feet and/or ankles. For example, due to the sloped medial and lateral edges 34, 36 of the front section 16B and the access position described herein, a foot held generally perpendicular to the lower leg (as positioned when standing) can enter the foot entry opening 23 with minimal need for dorsiflexion or plantar flexion during entry. The footwear 10 herein is depicted as a leisure shoe or an athletic shoe, but the present teachings also include an article of footwear that is a dress shoe, a work shoe, a sandal, a slipper, a boot, or any other category of footwear.

As indicated in FIG. 1, the footwear 10 may be divided into three general regions: a forefoot region 20, a midfoot region 22, and a heel region 24 which are also the forefoot region, the midfoot region, and the heel region, respectively, of the sole structure 12 and of the upper 16. The forefoot region 20 generally includes portions of the article of footwear 10 corresponding with the toes and the joints connecting the metatarsals with the phalanges. The midfoot region 22 generally includes portions of the article of footwear 10 corresponding with the arch area of the foot, and the heel region 24 corresponds with rear portions of the foot, including the calcaneus bone.

The sole structure 12 includes a midsole 26 and an outsole 28 secured to the midsole 26. The midsole 26 may be formed from a compressible polymer foam element (e.g., a polyurethane or ethylvinylacetate foam) that attenuates ground reaction forces (i.e., provides cushioning) when compressed between the foot and the ground during walking, running, or other ambulatory activities. In further configurations, the midsole 26 may incorporate fluid-filled chambers, plates, moderators, or other elements that further attenuate forces, enhance stability, or influence the motions of the foot. For example, the midsole 26 may include a recess in a proximal surface in the heel region 24, with a fluid-filled bladder element disposed in the recess in order to absorb forces resulting from heel impact. For example, the fluid-filled bladder element may be a polymeric bladder defining a sealed chamber filled with air or nitrogen. The midsole 26 is depicted as a single, one-piece midsole, but in other embodiments could be multiple components integrated as a unit. In some embodiments, the midsole 26 may be integrated with the outsole 28 as a unisole. The outsole 28 may be several discrete outsole components or may be one-piece, and may be formed from a wear-resistant rubber material that may be textured to impart traction and/or may include traction elements such as tread elements or cleats secured to a bottom surface of the midsole 26.

The sole structure 12 may include an insole 27 (shown in FIG. 6) positioned within the foot-receiving cavity 33 of the footwear 10, above a foot-facing surface 29 of the sole structure 12, so that the insole 27 is supported on the foot-facing surface 29. The foot-facing surface 29 of the sole structure 12 may be covered by a strobel secured to the front section 16A, and the insole 27 may rest on the strobel, rather than directly on the foot-facing surface 29. The sole structure 12 may include a heel extender 31 secured at a rear of the heel portion of the midsole 26, such as by adhesive or otherwise. The heel extender 31 may have a hardness greater than that of the midsole 26. For example, the heel extender 31 may be a thermoplastic polyurethane (TPU) material that is harder than a foam material of the midsole 26.

The footwear 10 has a lateral side 30 (FIG. 1) and a medial side 32 (FIG. 3) opposite from the lateral side 30, as also indicated in FIG. 6. The lateral side 30 and the medial side 32 extend through each of forefoot region 20, the midfoot region 22, and the heel region 24 and correspond with opposite sides of the article of footwear 10. The forefoot region 20, the midfoot region 22, the heel region 24, the lateral side 30 and the medial side 32 are not intended to demarcate precise areas of footwear 10, but are instead intended to represent general areas of footwear 10 to aid in the discussion.

The footwear upper 16 may be a variety of materials, such as leather, textiles, polymers, cotton, foam, composites, etc. In non-limiting examples, the footwear upper 16 may be a polymeric material capable of providing elasticity to the upper 16, and may be of braided construction, a knitted (e.g., warp-knitted) construction or a woven construction.

The front section 16A is fixed to the forefoot region 20 of the sole structure 12, and more specifically to the midsole 26, to partially define the foot-receiving cavity 33. In the embodiment shown, the front section 16A is configured as a mule and may be referred to as a mule section, as it extends from and is secured to the midsole 26 from the forefoot region 20 to the heel region 24, with a rear portion 35 extending around the heel region 24 from the lateral side 30 to the medial side 32 as shown in FIG. 6.

Figure 3:
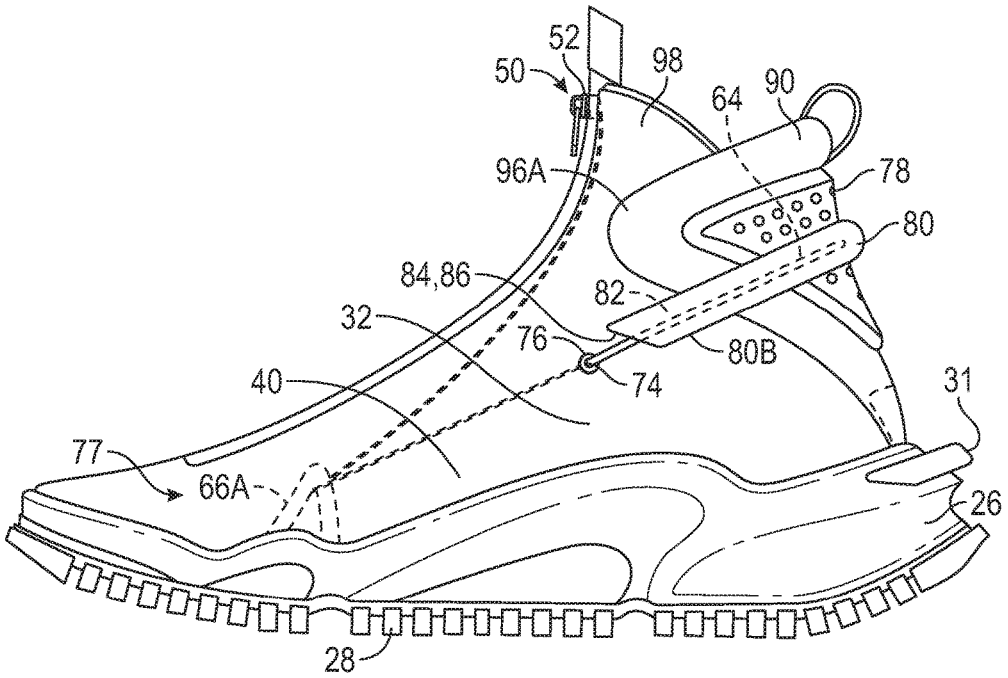
FIG. 3 is a medial side view of the article of footwear of FIG. 1.
Figure 8:
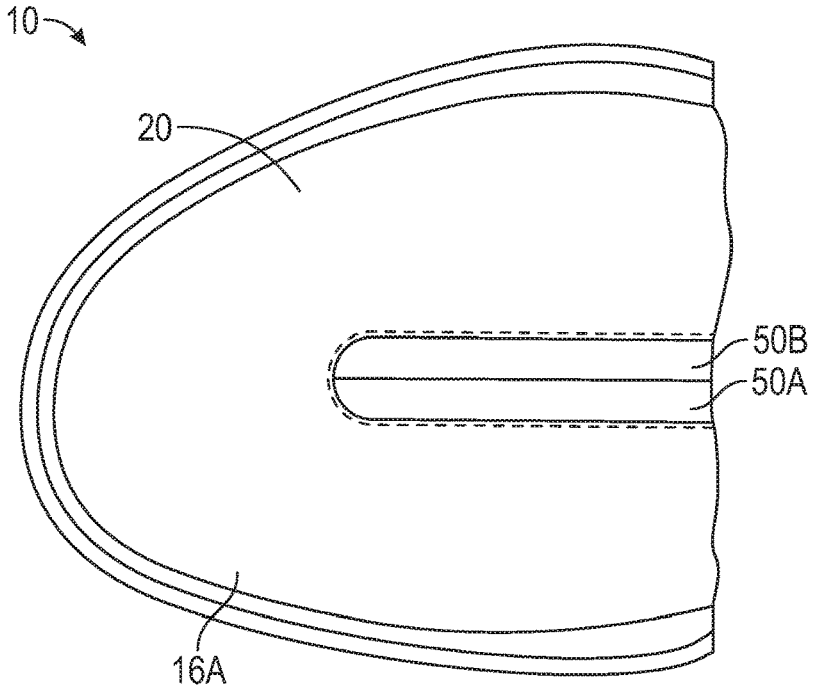
FIG. 8 is a fragmentary plan view of a forefoot portion of the article of footwear.

The front section 16A includes a medial portion 40, shown in FIGS. 3 and 6, and a lateral portion 42 shown in FIGS. 1 and 6. The medial portion 40 and the lateral portion 42 together define the foot-receiving cavity 33 over the sole structure 12, and the foot entry opening 23 of the foot-receiving cavity 33. The article of footwear 10 includes a zipper 50 secured to the medial portion 40 and to the lateral portion 42. The zipper 50 has a first set of teeth 46 and a second set of teeth 48 configured to meshingly engage with one another. The first set of teeth 46 extend along an edge of the medial portion 40, and the second set of teeth 48 extend along an edge of the lateral portion 42 as shown in FIG. 6. A portion of the upper 16 serves as a zipper cover 50A, 50B and may be integral with the medial portion 40 and the lateral portion 42, respectively, and may cover the teeth 46, 48 when in the zipper 50 is zipped, as shown in FIG. 8.

The zipper 50 includes a slider 52 engaged with the first and second sets of teeth 46, 48. More specifically, as best shown in FIGS. 1, 2, 3, and 6, the slider 52 is movable between a zipped position (FIGS. 1 and 3) and an unzipped position (FIGS. 2 and 6). The unzipped position is forward of the zipped position, and the medial portion 40 and the lateral portion 42 are zipped to one another when the slider 52 is in the zipped position.

Figure 4:
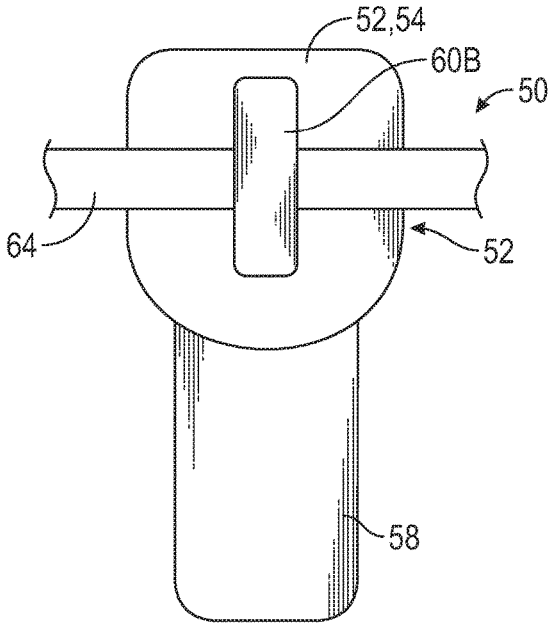
FIG. 4 is a bottom view of a double-headed slider and zipper pull of the zipper of FIG. 1, showing a cord in fragmentary view engaged with the slider.
Figure 5:
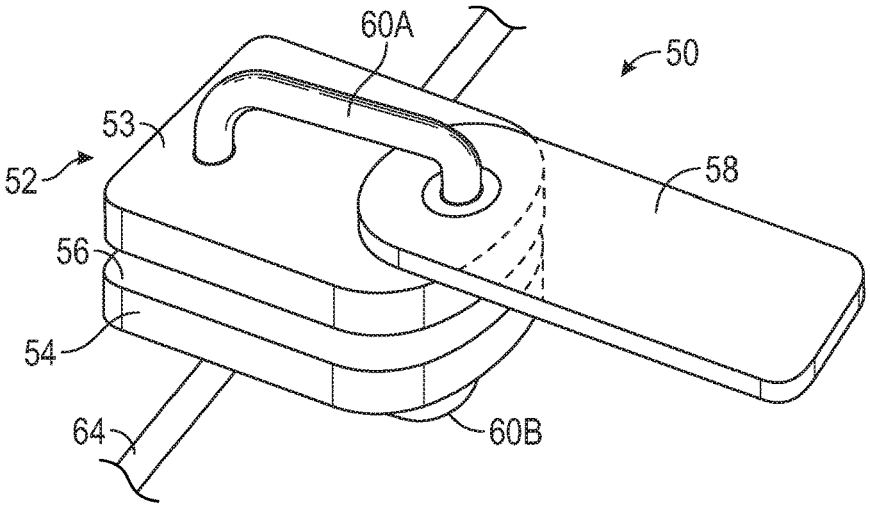
FIG. 5 is a perspective view of the slider and zipper pull of FIG. 4 showing the cord in fragmentary view.

As best shown in FIG. 5, the zipper 50 is a double-headed zipper, as the slider 52 has an outer head 53 and an inner head 54, with a slot 56 formed between the outer head 53 and the inner head 54. The first and second sets of teeth 46, 48 pass through the slot 56 at opposite sides of the slider 52 when the slider 52 moves along the sets of teeth 46, 48 between the zipped position and the unzipped position. A zipper pull 58 is secured to a crown 60A on the outer head 53. An alternative zipper pull of a longer length or a different material may be used. The inner head 54 also has a crown 60B as best shown in the bottom view of the slider 52 in FIG. 4. The inner head 54 need not have a zipper pull secured thereto. The inner head 54 and the crown 60B are disposed below the medial and lateral portions 40, 42, within the foot-receiving cavity 33 in the embodiment of FIGS. 1-10.

The rear section 16B is movable relative to the sole structure 12 and the front section 16A between the access position of FIG. 2 and the use position of FIG. 1 and moves from the access position to the use position when the slider 52 is moved from the unzipped position to the zipped position due in part to a cord 64 engaged with the zipper 50 and with the rear section 16B. The cord 64 is a flexible, elongated structure capable of withstanding a tensile load. The cord 64 may be, for example, a material such as a braided nylon. As used in this application and the accompanying claims, "cord" 64 can comprise any one of, or a plurality of, or any combination of two or more selected from among the following: a strap, a tether, a filament, a strand, a ribbon, a tube, a braid, a strip, a cable, a lace, a belt, a string, a thread, a rope, and a wire.

The cord 64 pulls the rear section 16B forward toward the front section 16A and partially closes the foot entry opening 23 when the slider 52 is moved from the unzipped position to the zipped position. In the embodiment of FIGS. 1-10, a single cord 64 extends along the rear section 16B and along both the medial portion 40 and the lateral portion 42 to the slider 52, as described herein. In an alternative embodiment, two separate cords could be used, a first cord that extends from the rear section 16B along the medial portion 40 to the slider 52, and a second cord that extends from the rear section 16B along the lateral portion 42 to the slider 52. In such a two cord embodiment, each cord would be separately attached to the rear section 16B. For example, each cord would have a rear end secured to the rear section 16B such as by stitching or by extending through a small hole in the rear section and being knotted at the end so that the end cannot pass through the hole. Each cord would have a front end at which the cord is tied around the crown 60B or otherwise secured to the slider 52. No conduit would be used in a two cord embodiment, as neither of the two cords would extend along the entire rear section 16B as in a single cord embodiment. In another embodiment, there may be only one of the looped anchors 66A, 66B with a cord extending through the looped anchor to the slider 52, and on the side of the upper 16 that does not have an anchor, an end of the cord 64 may be fixed to the front section 16A.

The article of footwear 10 further includes a medial anchor 66A and a lateral anchor 66B that help to route the cord 64 to enable the motion of the rear section 16B with the movement of the slider 52. The medial anchor 66A may be secured to the medial portion 40 of the front section 16A or to the sole structure 12, and in either case forward of the zipped position of the slider 52 and at a medial side of the article of footwear 10, as best shown in FIG. 3. The lateral anchor 66B may be secured to the lateral portion 42 of the front section 16A or to the sole structure 12 forward of the zipped position of the slider 52 and at a lateral side of the article of footwear 10, as best shown in FIG. 1. The medial and lateral anchors 66A, 66B may also be referred to as webbing, and may be but are not limited to a braided nylon or other material that resists abrasion as the cord 64 slides against the anchors 66A, 66B.

Figure 10:
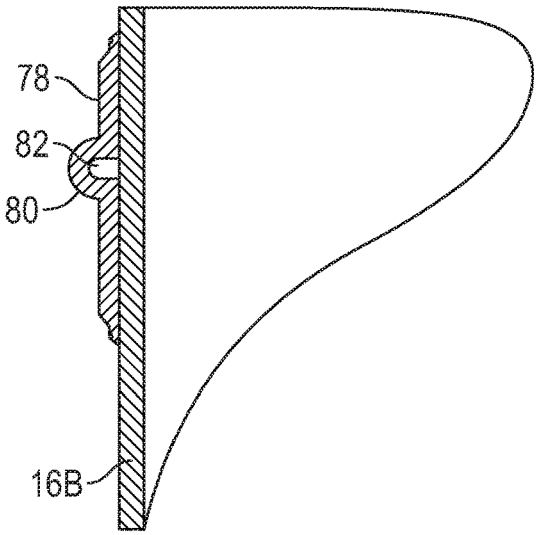
FIG. 10 is a cross-sectional view of the rear section of FIG. 9 taken at lines 10-10 in FIG. 9.
Figure 11:
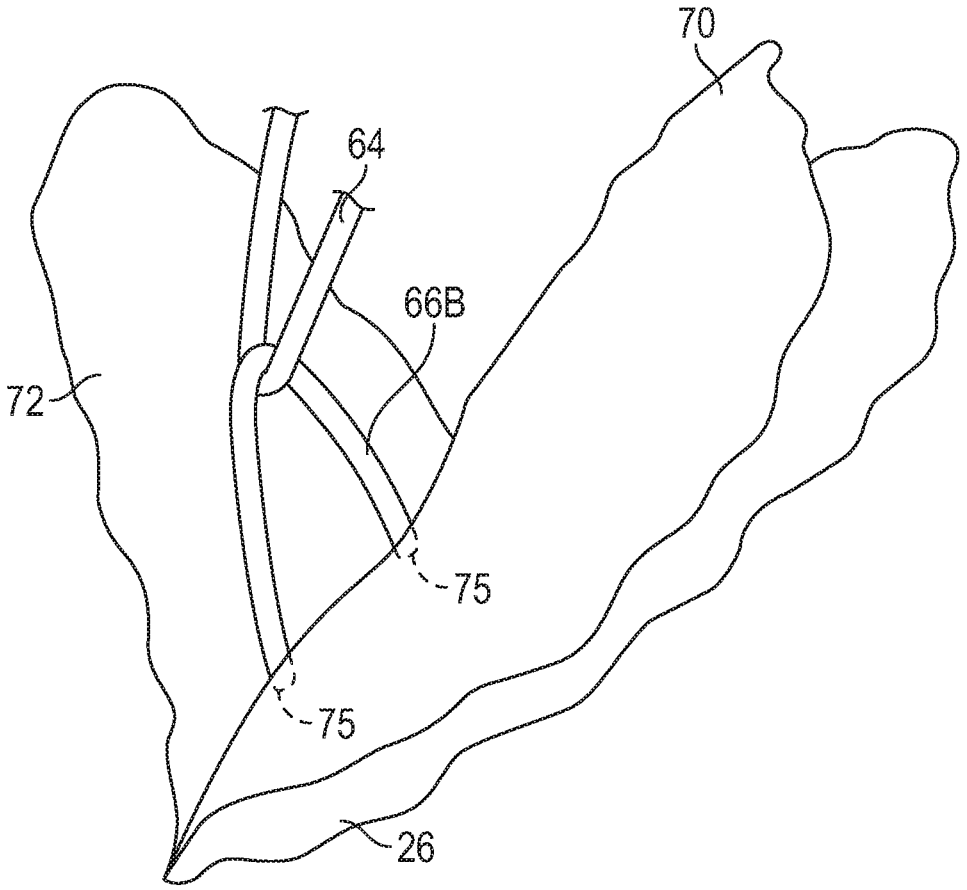
FIG. 11 is a fragmentary view of the article of footwear of FIG. 1 showing an embodiment with an anchor secured to the sole structure between inner and outer layers of the upper.

In the embodiment of FIG. 1, the medial and lateral anchors 66A, 66B are secured to the sole structure 12, and more specifically to the midsole 26 near a peripheral edge of the midsole, and are disposed between an inner layer 70 of the front section 16A and an outer layer 72 of the front section 16A, as best shown in FIG. 10 in which the inner layer 70 and outer layer 72 are separated from one another to reveal the anchor 66B. For example, ends 75 of the anchor 66B may be stitched or adhered to the midsole 26 in the same manner that the front section 16A of the upper is secured to the sole structure 12. An opening between the inner layer and the outer layer in which the anchors 66A, 66B are disposed may remain unobstructed by stitching or otherwise along the sets of teeth and in the region where the cord 64 moves as the slider 52 is moved from the zipped position to the unzipped position and vice versa. In other embodiments, the front section 16A may be a single layer, without an inner layer 70. In some embodiments, the anchors 66A, 66B may be disposed interior to the front section 16A, directly in the foot-receiving cavity 33, as illustrated with respect to anchor 66B in FIG. 7.

The anchors 66A, 66B each form loops through which the cord 64 passes. Because the anchors 66A, 66B are disposed between the inner layer 70 and the outer layer 72 in the embodiment of FIGS. 1-3, each is hidden from view, and as it is disposed internally of an exterior 77 of the front section. In alternative embodiments discussed with respect to FIGS. 11-14, one or both of the anchors is external to the exterior of the front section.

The medial portion 40 and the lateral portion 42 each have a cord opening 74 rearward of the medial anchor 66A and the lateral anchor 66B and forward of the rear section 16B even when the rear section 16B is in the closed position. The cord openings 74 may be reinforced by grommets 76 as shown. The cord 64 extends through the cord openings 74 such that the cord 64 is exposed externally of the front section 16A rearward of each cord opening 74, and the cord 64 is disposed between the inner layer 70 and the outer layer 72 forward of the cord opening 74 such that the cord 64 is not exposed externally forward of the cord openings 74. This allows the cord 64 to extend through the outer layer 72 to reach the internally-disposed anchors 66A, 66B, while being exposed externally of the front section 16A rearward of the openings 74 to extend to the rear section 16B, which with the cord 64 is also engaged.

Figure 9:
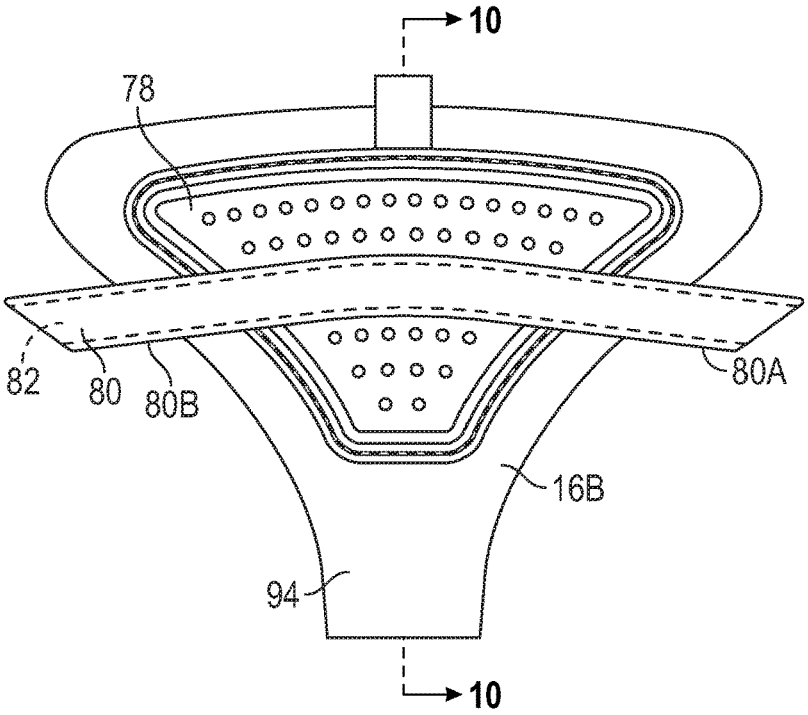
FIG. 9 is a rear view of the rear section of the upper of the article of footwear of FIG. 1.

With reference to FIG. 9, a support 78 with a conduit 80 is secured to the rear section 16B. The support 78 and conduit 80 may be integral. The conduit 80 at least partially defines a channel 82 extending in a U shape along the rear section 16B. In the embodiment shown, the conduit 80 and channel 82 are exterior to the support 78 and the rear section 16B. Alternatively, the conduit and channel could be disposed at an interior side of the rear section 16B. The conduit 80 could be separate from the support 78, and could be disposed at an interior side of the rear section 16B, or between inner and outer layers of the rear section 16B, for example.

The cord 64 extends through the channel 82 of the conduit 80, as illustrated in FIGS. 1-3. The material of the support 78 and the conduit 80 may be relatively smooth to enable the cord 64 to easily slide in the channel 82, and may be stiffer than the material of the rear section 16B at the hinge 18 in order to provide support for the rear of the ankle. For example, the support 78 and the conduit 80 may be TPU. The conduit 80 includes a lateral arm 80A and a medial arm 80B, each of which extends forward of the rear section 16B when the slider 52 is in the zipped position, and each of which includes a terminal end 84 with an opening 86 to the channel 82 at the terminal end 84. In other embodiments, the conduit 80 may end at the edges of the rear section 16B, or the conduit 80 may be a short loop at the rear of the rear section 16B. Additionally, in some embodiments, no support is provided, and a conduit through which the cord extends may be formed by a cover stitched or otherwise secured to the exterior surface of the rear section 16B, and need not be integral with a support.

The cord 64 is thus routed along the rear section 16B between an uppermost extent of the rear section 16B and the hinge 18, routes through both of the medial anchor 66A and the lateral anchor 66B, and is secured to the slider 52. Because the medial and lateral anchors 66A, 66B are disposed rearward of the slider 52 when the slider 52 is in the unzipped position, and forward of and lower than the slider 52 when the slider 52 is in the zipped position, the cord 64 pulls the rear section 16B forward toward the front section from the open position of FIG. 2 to the closed position of FIG. 1 by pivoting the rear section 16B about a pivot axis P of the hinge 18, shown in FIG. 6. The movement of the rear section 16B to the closed position partially closes the foot entry opening 23 when the slider 52 is moved from the unzipped position to the zipped position. The rear section 16B includes a collar portion 90 at an uppermost extent of the rear section 16B. The hinge 18 is between the collar portion 90 and the sole structure 12, and pivots generally about the pivot axis P. The cord 64 engages with the rear section 16B in the conduit 80, which is a position intermediate the hinge 18 and the uppermost extent 92 of the rear section.

As shown in FIG. 2, when the zipper 50 is unzipped, the length of the span of the cord 64 extending from the slider 52 to the medial or lateral anchor 66A, 66B is L1, and the length of the span of cord 64 extending from the medial or lateral anchor 66A, 66B to the respective arm 80A, 80B of the conduit 80 is L2. When the slider 52 is moved to the zipped position of FIG. 1, the length of the span of the cord 64 extending from the slider 52 to the medial or lateral anchor 66A, 66B is L3, and the length of the span of cord 64 extending from the medial or lateral anchor 66A, 66B to the respective arm 80A, 80B of the conduit 80 is L4, as shown in FIG. 1. The total length of the cord 64 from the slider 52 to the respective arm 80A, 80B remains constant, so that the sum of the lengths L1 and L2 is the same as the sum of the lengths L3 and L4. With the zipper in the zipped position, the length L3 is much greater than the length L1, and the length L4 is much less than the length L2. Stated differently, when the slider 52 moves to the zipped position, the cord 64 slides through the anchors 66A, 66B, and a portion of the cord 64 previously rearward of the respective anchors 66A, 66B when the rear section 16B is in the open position slides through the anchor 66A or 66B and upward to extend up and back from the anchor toward the slider 52 in the zipped position. When the slider 52 is moved to the unzipped position, the portion of the cord 64 slides back through the anchor 66A or 66B and is disposed rearward of the anchor 66A, or 66B, between the anchor and the arm 80A or 80B, allowing the rear section 16B to pivot at the hinge 18 to the open position. The rear section 16B may automatically pivot to the open position, or may be pivoted to the open position manually once the slider 52 is in the unzipped position, providing sufficient slack for the cord 64.

The rear section 16B of the upper is sufficiently flexible between the support 78 and the sole structure 12 that it articulates relative to the sole structure 12 at the hinge 18. For example, the rear section 16B narrows to a neck 94 at the sole structure 12, as best shown in FIGS. 6 and 9, enabling bending at the neck 94. Still further, a flexible insert, such as a bi-stable element may be secured to the sole structure and extend along the neck 94 of the rear section 16B. The bi-stable element may have two stable positions: at the open position of the rear section 16B, and the closed position of the rear section 16B. The bi-stable element thus may bias the rear section 16B toward either one of the closed position and the open position, encouraging movement of the rear section 16B toward the other stable position when the rear section 16B is moved away from one of the stable positions via the cord 64.

In addition to the rear section 16B moving or being movable to the open position when the slider 52 is moved to the unzipped position, the front section 16A of the upper 16 is sufficiently flexible such that the medial portion 40 and the lateral portion 42 of the front section 16A spread laterally outward or may be manually spread laterally outward of the sole structure 12 and away from one another when the slider 52 is in the unzipped position, as best shown in FIG. 6, thereby even further opening the foot-receiving cavity 33 for foot entry. These splayed positions of the medial portion 40 and the lateral portion 42, along with the open position of the rear section 16B also enable easy cleaning of the upper 16, and quick drying of the upper 16.

As best shown with the rear section 16B in the closed position of FIGS. 1 and 3, the upper 16 is a high-top upper as it includes an ankle region 98 configured to be sufficiently high so that it surrounds an ankle when a foot is inserted in the foot-receiving cavity 33. The rear section 16B flares laterally outward from the tapered neck 94, forming a medial wing 96A and a lateral wing 96B of the collar portion 90. The wings 96A, 96B enable the collar portion 90 to overlap the medial portion 40 and the lateral portion 42 of the front section 16A when the slider 52 is in the zipped position. The overlap occurs in an ankle region 98 of the high top upper 16, with the overlap of the front and rear sections 16A, 16B at the wings 96A, 96B thus serving to further support the ankle.

Figure 12:
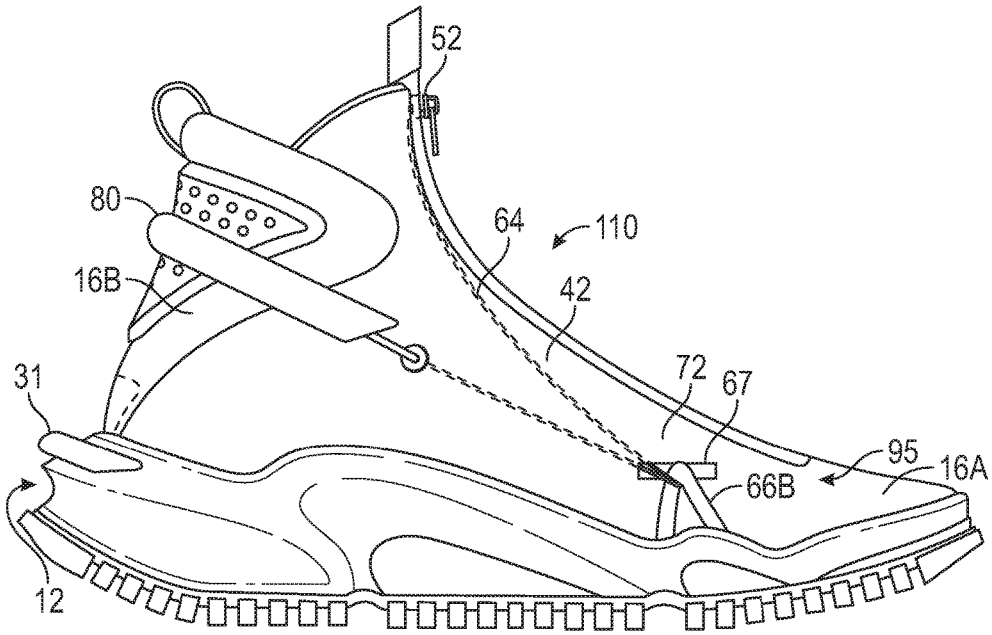
FIG. 12 is a lateral side view of an article of footwear with a zipper in a zipped position and a rear section in a closed position, in accordance with an alternative aspect of the present teachings.
Figure 13:
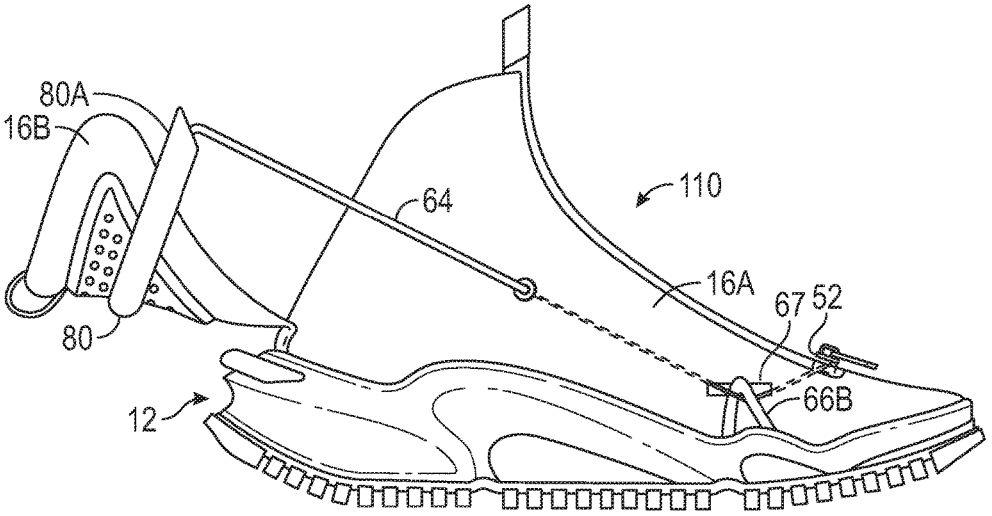
FIG. 13 is a lateral side view of the article of footwear of FIG. 12 with the zipper in an unzipped position and the rear section in an open position.

FIGS. 12-13 show another embodiment of an article of footwear 110 that has many of the same features as the article of footwear 10 that function as described with respect to the article of footwear 10. However, instead of being disposed between an inner layer and an outer layer of the front section 16B, either or both of the medial anchor 66A and the lateral anchor 66B are disposed exterior to an exterior surface 95 of the front section 16A. FIGS. 12-13 show only the lateral anchor 66B disposed in this manner, but the medial anchor 66A may be similarly disposed. In order for the cord 64 to be disposed between the inner and outer layers 70, 72 of the front section 16A and still extend through externally-disposed anchors 66A, 66B, an opening 67 that may be a slit or a slot extends through the outer layer 72 at the lateral portion 42. The opening 67 is sufficiently shaped and sized to permit the cord 64 to extend through the outer layer 72 adjacent the lateral anchor 66B and slide therethrough while also moving relative to the lateral anchor 66B with the slider 52. If the medial anchor 66A is similarly disposed exterior to the exterior surface of the front section 16A, then an additional similar opening 67 is disposed at the medial portion 40.

Figure 14:
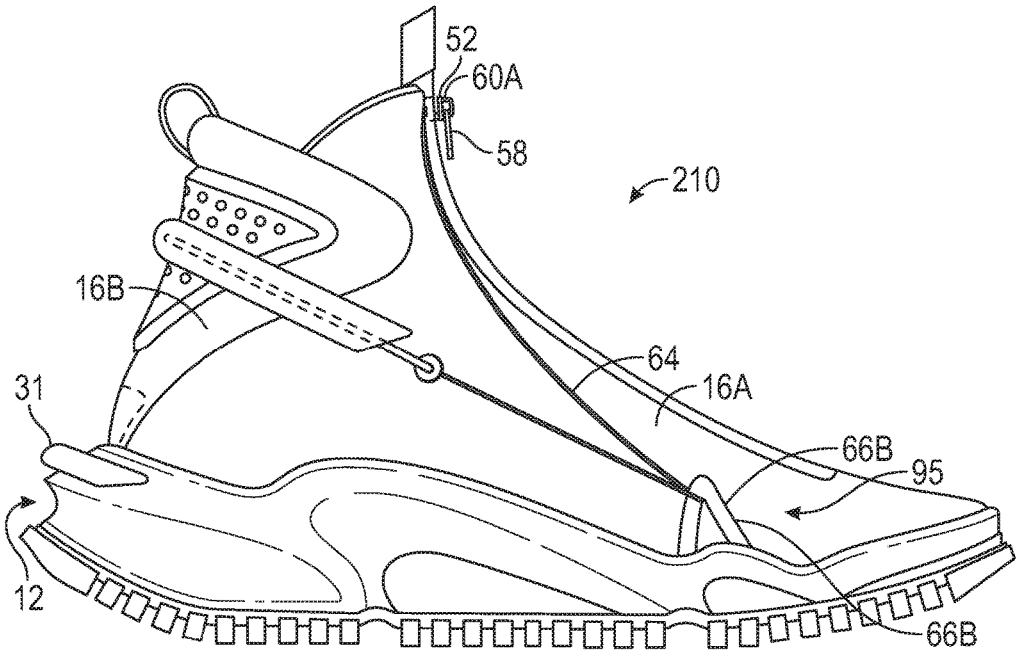
FIG. 14 is a lateral side view of an article of footwear with a zipper in a zipped position and a rear section in a closed position, in accordance with an alternative aspect of the present teachings.
Figure 15:
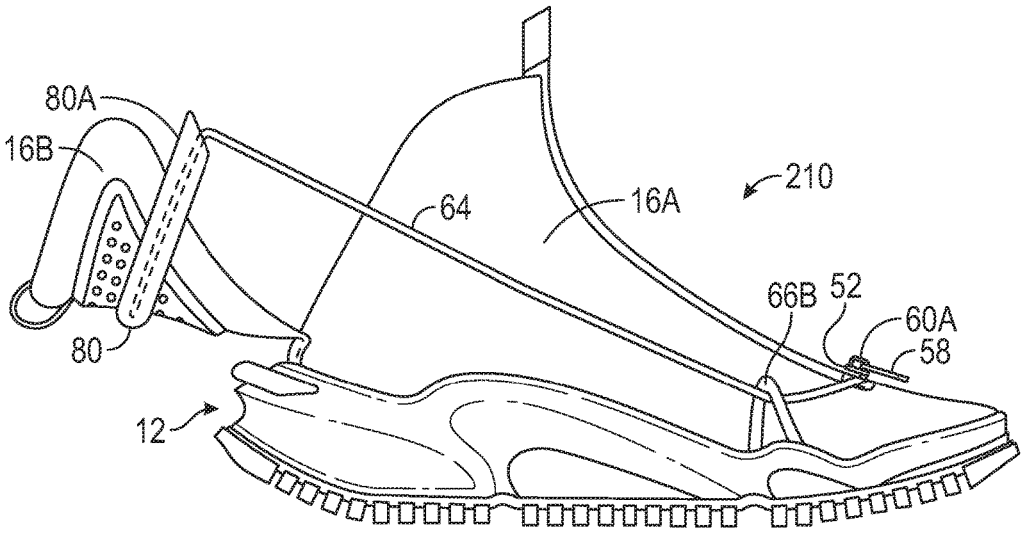
FIG. 15 is a lateral side view of the article of footwear of FIG. 14 with the zipper in an unzipped position and the rear section in an open position.

FIGS. 14-15 show another alternative embodiment of an article of footwear 210 in which the medial and lateral anchors 66A, 66B are disposed exterior to the exterior surface 95 of the front section 16A, and the cord 64 is also disposed exterior to the exterior surface 95. In such an embodiment, the cord 64 extends through the crown 60A along with the zipper pull 58, and the slider 52 need not be a double-slider.

"A", "an", "the", "at least one", and "one or more" are used interchangeably to indicate that at least one of the items is present. A plurality of such items may be present unless the context clearly indicates otherwise. All numerical values of parameters (e.g., of quantities or conditions) in this specification, unless otherwise indicated expressly or clearly in view of the context, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. In addition, a disclosure of a range is to be understood as specifically disclosing all values and further divided ranges within the range. All references referred to are incorporated herein in their entirety.

The terms "comprising", "including", and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items. The term "any of" is understood to include any possible combination of referenced items, including "any one of" the referenced items. The term "any of" is understood to include any possible combination of referenced claims of the appended claims, including "any one of" the referenced claims.

To assist and clarify the subsequent description of various embodiments, various terms are defined herein. Unless otherwise indicated, the following definitions apply throughout this specification (including the claims). For consistency and convenience, directional adjectives are employed throughout this detailed description corresponding to the illustrated embodiments. Those having ordinary skill in the art will recognize that terms such as "above", "below", "upward", "downward", "top", "bottom", etc., may be used descriptively relative to the figures, without representing limitations on the scope of the invention, as defined by the claims.

The term "longitudinal," as used throughout this detailed description and in the claims, refers to a direction extending a length of a component. For example, a longitudinal direction of a shoe extends between a forefoot region and a heel region of the shoe. The term "forward" is used to refer to the general direction from a heel region toward a forefoot region, and the term "rearward" is used to refer to the opposite direction, i.e., the direction from the forefoot region toward the heel region. In some cases, a component may be identified with a longitudinal axis as well as a forward and rearward longitudinal direction along that axis.

The term "lateral direction," as used throughout this detailed description and in the claims, refers to a side-to-side direction extending a width of a component. In other words, the lateral direction may extend between a medial side and a lateral side of a component, with the lateral side of the component being the surface that faces away from the other foot, and the medial side being the surface that faces toward the other foot. In some cases, a component may be identified with a lateral axis, which is perpendicular to a longitudinal axis. Opposing directions along the lateral axis may be directed towards the lateral and medial sides of the component.

The term "side," as used in this specification and in the claims, may refer to any portion of a component facing generally in a lateral, medial, forward, or rearward direction, as opposed to an upward or downward direction.

The term "vertical," as used throughout this detailed description and in the claims, refers to a direction generally perpendicular to both the lateral and longitudinal directions. For example, in cases where a sole is planted flat on a ground surface, the vertical direction may extend from the ground surface upward. It will be understood that each of these directional adjectives may be applied to individual components of a sole. The term "upwards" refers to the vertical direction pointing towards a top of the component, which may include an instep, a fastening region and/or a throat of an upper. The term "downwards" refers to the vertical direction pointing opposite the upwards direction, and may generally point towards the sole, or towards the outermost components of the sole.

The "interior" of an article of footwear such as a shoe refers to portions at the space that is occupied by a wearer's foot when the shoe is worn. The "inner side" of a component refers to the side or surface of the component that is (or will be) oriented toward the interior of the shoe in an assembled shoe. The "outer side" or "exterior" of a component refers to the side or surface of the component that is (or will be) oriented away from the interior of the shoe in an assembled shoe. In some cases, the inner side of a component may have other components between that inner side and the interior in the assembled shoe. Similarly, an outer side of a component may have other components between that outer side and the space external to the assembled shoe. Further, the terms "inward" and "inwardly" shall refer to the direction toward the interior of the component or article of footwear, such as a shoe, and the terms "outward" and "outwardly" shall refer to the direction toward the exterior of the component or article of footwear, such as the shoe. In addition, the term "proximal" refers to a direction that is nearer a center of a footwear component, or is closer toward a foot when the foot is inserted in the article as it is worn by a user. Likewise, the term "distal" refers to a relative position that is further away from a center of the footwear component or is further from a foot when the foot is inserted in the article as it is worn by a user. Thus, the terms proximal and distal may be understood to provide generally opposing terms to describe the relative spatial position of a footwear layer.

While several modes for carrying out the many aspects of the present teachings have been described in detail, those familiar with the art to which these teachings relate will recognize various alternative aspects for practicing the present teachings that are within the scope of the appended claims. It is intended that all matter contained in the above description or shown in the accompanying drawings shall be interpreted as illustrative and exemplary of the entire range of alternative embodiments that would an ordinarily skilled artisan would recognize as implied by, structurally and/or functionally equivalent to, or otherwise rendered obvious based upon the included content, and not as limited solely to those explicitly depicted and/or described embodiments.

What is claimed is:

1. An article of footwear comprising:

a sole structure;

an upper including a front section and a rear section, both secured to the sole structure; wherein the front section is fixed to the sole structure at least partially forward of the rear section and includes a medial portion and a lateral portion that together define a foot-receiving cavity over the sole structure, and a foot entry opening of the foot-receiving cavity;

a zipper secured to the medial portion and to the lateral portion and including a slider movable between a zipped position and an unzipped position, the unzipped position forward of the zipped position; wherein the medial portion and the lateral portion are zipped to one another when the slider is in the zipped position;

an anchor secured to one of the front section or the sole structure forward of the zipped position of the slider; and a cord engaged with the zipper and with the rear section of the upper, and routed through the anchor;

wherein the cord pulls the rear section forward toward the front section so that the rear section partially closes the foot entry opening when the slider is moved from the unzipped position to the zipped position.

2. The article of footwear of claim 1, wherein the cord is engaged with the slider.

3. The article of footwear of claim 1, wherein the anchor at least partially defines a loop, and the cord passes through the loop.

4. The article of footwear of claim 1, wherein the anchor is disposed internally of an exterior of the front section.

5. The article of footwear of claim 1, wherein the anchor is disposed externally of an exterior of the front section.

6. The article of footwear of claim 1, wherein:

the front section has a cord opening rearward of the anchor and forward of the rear section; and the cord extends through the cord opening such that the cord is exposed externally of the front section rearward of the cord opening, and extends internally of the front section forward of the cord opening.

7. The article of footwear of claim 6, wherein:

the front section includes an inner layer and an outer layer; and the cord is disposed between the inner layer and the outer layer and forward of the cord opening.

8. The article of footwear of claim 1, wherein the anchor is a lateral anchor disposed adjacent to the lateral portion, and further comprising:

a medial anchor secured to one of the medial portion or the sole structure forward of the zipped position of the slider, and wherein the cord is routed through the medial anchor.

9. The article of footwear of claim 1, wherein the medial portion and the lateral portion of the front section spread laterally outward of the sole structure when the slider is in the unzipped position.

10. The article of footwear of claim 1, wherein:

the rear section includes a hinge adjacent to the sole structure, and the cord engages with the rear section at a position intermediate the hinge and an uppermost extent of the rear section.

11. The article of footwear of claim 1, further comprising a conduit secured to the rear section; and wherein the cord extends through the conduit.

12. The article of footwear of claim 11, wherein the conduit at least partially defines a channel extending in a U shape along the rear section.

13. The article of footwear of claim 12, wherein:

the conduit includes a lateral arm and a medial arm each of which extends forward of the rear section when the slider is in the zipped position, and each of which includes a terminal end with an opening to the channel at the terminal end.

14. The article of footwear of claim 1, wherein:

the rear section includes a collar portion and a hinge between the collar portion and the sole structure;

the rear section articulates relative to the sole structure at the hinge; and the collar portion overlaps the medial portion and the lateral portion of the front section when the slider is in the zipped position.

15. An upper for an article of footwear comprising:

a front section and a rear section; wherein the front section includes a forefoot region and a midfoot region, and partially defines a foot-receiving cavity with a foot entry opening posterior of the midfoot region; wherein the front section has a medial portion and a lateral portion;

a zipper secured to the medial portion and to the lateral portion and including a slider movable between a zipped position and an unzipped position, the unzipped position forward of the zipped position; wherein the medial portion and the lateral portion are zipped to one another when the slider is in the zipped position;

an anchor disposed forward of the zipped position and adjacent to the front section; and a cord engaged with the zipper and with the rear section of the upper, and routed through the anchor;

wherein the cord pulls the rear section forward toward the front section from an access position to a use position when the slider is moved from the unzipped position to the zipped position, the rear section partially closing the foot entry opening in the use position.

16. The upper of claim 15, wherein:

the front section has a cord opening rearward of the anchor and forward of the rear section; and the cord extends through the cord opening, and is exposed externally of the front section rearward of the cord opening, and extends internally of the front section forward of the cord opening.

17. The upper of claim 15, wherein:

the front section includes an inner layer and an outer layer; and the cord is disposed between the inner layer and the outer layer and forward of the cord opening.

18. The upper of claim 15, wherein the medial portion and the lateral portion of the front section spread laterally outward away from one another when the slider is in the unzipped position.

19. The upper of claim 15, wherein:

the rear section includes a collar portion at an uppermost extent of the rear section; and the collar portion overlaps the medial portion and the lateral portion of the front section when the slider is in the zipped position.

20. The upper of claim 15, in combination with a sole structure; wherein the medial portion, the lateral portion, and the rear section are secured to the sole structure; and wherein the rear section has a hinge and articulates relative to the sole structure at the hinge.

* * * * *